US005656351A

United States Patent [19]

Donaruma

[11] Patent Number: 5,656,351

[45] Date of Patent: Aug. 12, 1997

[54] HOOK AND LOOP FASTENER INCLUDING AN EPOXY BINDER

[75] Inventor: L. Guy Donaruma, Punta Gorda, Fla.

[73] Assignee: Velcro Industries B.V., Curacao, Netherlands

[21] Appl. No.: 587,140

[22] Filed: Jan. 16, 1996

[51] Int. Cl.[6] ..... B32B 3/02; B32B 3/06; B05D 3/02; A44B 1/04

[52] U.S. Cl. ..... 428/97; 428/92; 428/96; 428/100; 24/442; 24/444; 427/386; 427/389.9; 427/394

[58] Field of Search ..... 428/92, 96, 97, 428/100; 24/442, 444; 427/386, 389.9, 394

[56] References Cited

U.S. PATENT DOCUMENTS

| | | | |
|---|---|---|---|
| 2,423,555 | 4/1947 | Ender . | |
| 2,575,558 | 7/1951 | Newey et al. . | |
| 3,530,032 | 9/1970 | Ragir . | |
| 3,666,695 | 5/1972 | Jachimowicz et al. . | |
| 3,708,382 | 1/1973 | Erb . | |
| 3,943,981 | 3/1976 | De Brabander | 428/92 |
| 4,361,925 | 12/1982 | Yamamoto et al. . | |
| 4,646,397 | 3/1987 | Yoshida | 24/442 |
| 4,761,318 | 8/1988 | Ott et al. . | |
| 4,770,917 | 9/1988 | Tochacek et al. . | |
| 4,910,062 | 3/1990 | Zinke et al. . | |
| 4,931,343 | 6/1990 | Becker et al. | 428/92 |
| 5,436,051 | 7/1995 | Donaruma et al. | 428/100 |

FOREIGN PATENT DOCUMENTS

| | | |
|---|---|---|
| 331 215 | 9/1989 | European Pat. Off. . |
| 350 240 | 1/1990 | European Pat. Off. . |

OTHER PUBLICATIONS

Abstracts, American Chemical Society, 1991 (Teltech, Inc.).

Guise et al. "Structural Studies of Shrink–resist Polymers for Wool: Polyisocynates w/different Backbones" JSDC Jan. 1976 pp. 17–21.

*Primary Examiner*—Terrel Morris

*Attorney, Agent, or Firm*—Fish & Richardson P.C.

[57] ABSTRACT

The present invention features an improved hook and loop fastener. The fastener includes a ground sheet and a pile of hook or loop elements extending from the ground sheet, and a solidified binder impregnating the ground sheet. The binder advantageously comprises a thermoset epoxy adhesive, providing the fastener with excellent durability and resistance to laundering and dry-cleaning.

13 Claims, 1 Drawing Sheet

HOOK AND LOOP FASTENER INCLUDING AN EPOXY BINDER

BACKGROUND OF THE INVENTION

The present invention relates to hook and loop fasteners.

Hook and loop fasteners comprise mating strips or patches of filamentary stress-bearing hooks and loops. Monofilament or multifilament loops are knit or woven into a textile backing, or ground, to form the loop component of the fastener. To form the hook component, monofilament loops are woven in the same manner, then passed through a hook cutting process in which portions of the monofilament loops are cut away to form hooks. The loops and hooks will be referred to collectively herein as "pile".

A binder is applied to the ground side of the hook or loop component, in a manner so that it impregnates the ground, in order to supplement, with an adhesive bond, the frictional interlocking of the pile filaments with the ground filaments that results from the weaving process.

The binder matrix adds strength and durability to the fastener. Depending upon the quality of the binder, the hooks and loops may pull out of the ground, and the ground may start to fray, after a number of cycles of closing and opening the fastener. Damage may also occur during manufacture of the fastener, e.g., to the loops during a "napping" process in which they are contacted with a roll having a surface formed by cut wires in order to extend the loops and thus increase the peel strength of the hook/loop bond, or to the hooks during the hook cutting step described above.

Thus, the strength of the binder is important in providing sufficient resistance to hook or loop pull out during manufacture and use. The material used for the binder will greatly affect the fastener's performance. It is desirable that the material be able to withstand numerous cycles of opening and closing, and not break down appreciably under laundering or dry cleaning conditions.

In addition to the particular material used for the binder, the manner in which the binder is applied can affect the fastener's performance. For optimal strength, the binder should impregnate the ground as fully as possible. At the same time, it should not be allowed to wick into the hooks or loops, as that interferes with their ability to engage each other and reduces the effectiveness of the fastener.

The manner in which a binder is applied also affects the cost to produce the fastener. Current fasteners often use binders which are applied to the ground as a solution or as a dispersion. These binders require additional chemicals to effect their cure (cross-linking), and ovens to dry them and promote cross-linking; the production line can be quite long as a result. The chemicals used to cross-link the binder, e.g., formaldehyde or aziridines, are often environmentally undesirable, if not toxic. Other, hot-melt binders require that the ground and binder be heated during application. Thus, high energy and capital costs, extensive factory manpower and floorspace, and environmental undesirability are often associated with the binders currently used in hook and loop fastener systems.

New binders are continually sought which would be low in cost, easy to apply at high production rates, and which, in use, would be highly resistant to the conditions encountered by hook and loop fasteners, e.g., laundering and dry-cleaning.

SUMMARY OF THE INVENTION

The present invention features improved hook and loop fasteners fabricated with various binders which improve the strength and durability of the fastener. In a first general aspect, a hook or loop component of a hook and loop fastener has a ground sheet and a pile of hook or loop elements extending from the ground sheet, and a solidified binder impregnating the ground sheet. The binder advantageously comprises a thermoset epoxy adhesive, providing the fastener with excellent durability and resistance to laundering and dry-cleaning. The fray resistance of the fastener has also been found to be excellent.

In preferred embodiments, the binder is a two-component epoxy adhesive, i.e., an adhesive comprising an epoxy resin and a cross-linking agent that, when mixed with the resin, causes the mixture to solidify. Preferably the adhesive has a relatively long pot life (time before solidification) at room temperatures, preferably greater than 20 minutes for a 100 g. mass, and a relatively fast cross-linking time at moderately elevated temperatures, preferably less than 5 minutes, more preferably less than 1 minute at 200°–300° F. This balance of properties allows the binder to be easily applied and cross-linked at high production rates.

It is also preferred that the two components be liquid at room temperature, allowing them to be easily metered and mixed without melting or dissolving them.

Preferred epoxy resins include the reaction products of bisphenol A or bisphenol F and epichlorohydrin. Preferred cross-linking agents include aliphatic amines, amine-functional polyamides, anhydrides, mercaptans and cycloaliphatic amines.

In another aspect, the invention features a method of producing components of hook and loop fasteners in which a layer of a thermosettable epoxy adhesive binder is applied to a ground sheet having a pile of hooks or loops e.g., the ground sheet is saturated with an epoxy adhesive under conditions enabling penetration of the thickness of the ground sheet without contamination of the pile, and thereafter the epoxy resin binder is allowed to cross-link to form a solidified epoxy binder. The epoxy resin is cross-linkable, and the epoxy adhesive includes a cross-linking agent selected so that cross-linking results in cross-linked bonds.

Conditions which enable proper penetration include spreading the epoxy adhesive with a coating knife which urges it into the interstices of the ground sheet; applying the adhesive at a location on the ground sheet which is suspended between two support points, and pressing the knife against the ground sheet so as to bend it around the knife edge in V-shaped fashion. Another technique which enables proper penetration is roll coating, a process that is well known in the coating field.

In preferred embodiments of this aspect, substantially immediately prior to applying the adhesive the adhesive is formed by mixing predetermined portions of an epoxy resin and a cross-linking agent for the epoxy resin; the binder is applied by roll coating; and cross-linking is accelerated by heating the adhesive-impregnated ground, more preferably by heating at 200°–300° F. Certain epoxy/cross-linking agent combinations will preferably be cross-linked at room temperature, as is well known in the art.

Other features and advantages of the invention will be apparent from the following detailed description and from the claims.

DESCRIPTION OF THE PREFERRED EMBODIMENTS

Figure 1:
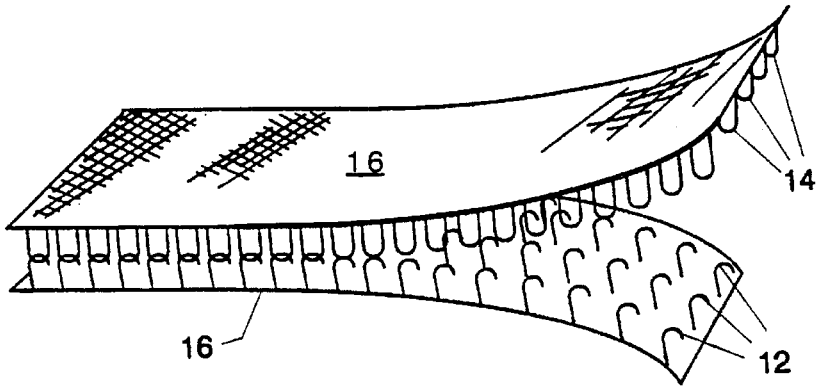
FIG. 1 is a perspective view of a hook and loop fastener, partially peeled apart, showing mating strips of hook elements and loop elements.
Figure 2:
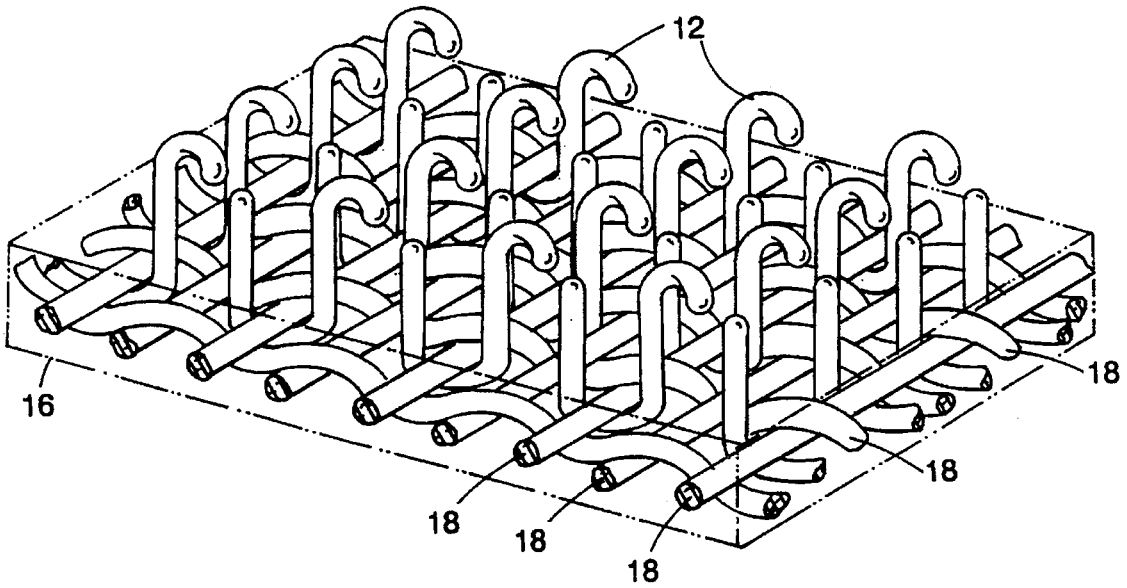
FIG. 2 is a perspective view, highly magnified, of a strip of hook elements, showing the hooks interwoven in a textile ground.

As noted above, hook and loop fasteners comprise mating strips or patches of filamentary stress-bearing hooks 12 and loops 14, as shown in FIG. 1. As shown in FIG. 2, the hooks 12 are woven into a textile backing, or ground, 16. Similarly, the loops 14 are knit or woven into a ground 16. In order to secure the hooks 12 and loops 14, generically referred to as pile elements, to the ground 16 and to bond the fibers 18 composing the ground to each other, in a manner to withstand the forces involved, the ground is impregnated with a resinous binder, suggested by the stippling 19, to form a composite structure.

Suitable materials for the ground and the fastener elements are well known in the art, e.g., nylon or polyester fibers.

Suitable adhesives for use in the binder layer are thermoset epoxy adhesives, i.e., adhesives which include a resin having epoxide groups that react with a cross-linking agent to form cross-links between the polymer chains of the resin so that, when thus cross-linked, the adhesive cannot be melted. The adhesive may be a one-component adhesive, i.e., in the epoxy resin and cross-linking agent do not react at room temperature when mixed and thus can be mixed and stored prior to application, or a two-component adhesive, i.e., the cross-linking agent and adhesive, when mixed, react at room temperature and thus can only be mixed immediately prior to application. Two component systems are preferred for their rapid rate of cross-linking at elevated temperatures. If a one-component system is used, it is preferred that it contain an accelerator, as is well known in the art, to increase the cross-linking rate at the desired cross-linking temperature.

Preferred epoxy resins include those based on bisphenol A, e.g., epoxy resins commercially available from Shell under the tradenames EPON 828 and EPON 825, those based on bisphenol F, e.g., those commercially available from Shell under the tradename EPON 868, and similar resins modified to reduce viscosity, e.g., EPON 813, 815 and 8132 resins. Generally, it is preferred that the resin be liquid at room temperature.

Suitable cross-linking agents include, but are not limited to, aliphatic amines, such as those available from Shell under the tradenames EPI-CURE 3270 and 3274, polyamides, amido amines, anhydrides, mercaptans, and other cross-linking agents for epoxy resins, of which many are well known by those skilled in the art.

The adhesive can contain other conventional additives, e.g., pigments and flame retardant additives, as is well known in the adhesive art.

The preferred mix ratio (i.e., ratio of epoxy resin to cross-linking agent in the adhesive) will depend upon the cross-linking agent selected, as is known in the art. Generally, preferred mix ratios are in the range of about 1:1 to 2:1.

Preferably, the resin, cross-linking agent, mix ratio, and optional accelerators are selected to enable the adhesive to cross-link rapidly, preferably in one minute or less, at a temperature which will not damage the ground or fastener elements, typically 200°–300° F. It is also preferred that the selection be made to provide a pot life long enough to allow the adhesive to be applied to the ground prior to an excessive increase in viscosity that would make the adhesive difficult to spread. Preferred adhesives have a pot life of about 20–60 minutes in a 100 g. mass, and a viscosity of from about 500 to 15,000 centipoise.

Binder coating a hook and loop fastener may be accomplished by using a conventional meter-mix dispenser to meter out and mix the proper quantities of the two components of the adhesive, as is well known in the adhesive art, and dispense the mixture through a dispensing nozzle. The mixture is then roll coated to spread the mixture uniformly across the width of the ground, which has hook or loop elements woven therethrough. Preferably, the coating is applied at about 0.003–0.008 grams/cm$^2$. At less than 0.003 grams/cm$^2$, fray resistance will tend to be poor; at greater than 0.008 grams/cm$^2$, the binder will tend to penetrate through the web and wick undesirably into the pile filaments. The coating is applied by metered roll coating, as is well known. The coated ground is then passed into a tunnel convection or IR oven to cross-link the binder. Preferably the coated ground is allowed to cool after its emergence from the oven.

The following example is intended to be illustrative and not limiting in effect.

EXAMPLE

EPON 828 resin and EPI-CURE 3274 curing agent were mixed in a 1:1 ratio to form a first adhesive. EPON 838 resin and EPI-CURE 3270 curing agent were also mixed in a 1:1 ratio to form a second adhesive. Separate portions of 1004 white nylon hook 88 tape were coated with each of these adhesives, using a 2 mil Gardner Blade Hand Coater. Each sample was then placed in a 280° F. oven for 1 minute, followed by conditioning for 24 hours at 73° F., 50% RH.

Both samples exhibited excellent fray resistance after laundering.

Other embodiments are within the claims.

I claim:

1. A hook and loop fastener comprising:

a ground sheet and a pile of hook or loop elements extending from the ground sheet, and a solidified binder impregnating the ground sheet, wherein said binder comprises a thermoset epoxy adhesive and said pile is substantially free of said binder.

2. A hook and loop fastener of claim 1 wherein said adhesive, prior to cross-linking, comprises an epoxy resin and a cross-linking agent for said epoxy resin.

3. A hook and loop fastener of claim 2 wherein said epoxy resin is selected from the group consisting of the reaction product of bisphenol A and epichlorohydrin and the reaction product of bisphenol F and epichlorohydrin.

4. A hook and loop fastener of claim 2 or 3 wherein said cross-linking agent is selected from the group consisting of aliphatic amines, anhydrides, mercaptans, polyamides and amido amines.

5. A hook and loop fastener of claim 2 wherein said epoxy resin and said cross-linking agent are selected and are provided in a predetermined ratio to allow said thermoset epoxy adhesive to cross-link in less than 5 min. at 200°–300° F.

6. A hook and loop fastener of claim 2 wherein said epoxy resin and said cross-linking agent are selected and are provided in a predetermined ratio to allow said thermoset epoxy adhesive to cross-link in less than 1 min. at 200°–300° F.

7. A hook and loop fastener of claim 5 or 6 wherein said mix ratio is from about 1:1 to 2:1.

8. A hook and loop fastener of claim 1 wherein said binder is applied to said ground at a weight of 0.003 to 0.008 grams/cm$^2$.

9. A method of manufacturing a hook and loop fastener comprising providing a ground sheet and a pile of hook or loop elements extending from the ground sheet applying a layer of thermosettable epoxy adhesive binder to the ground sheet under conditions enabling penetration of the thickness of the ground sheet without contamination of the pile, and solidifying and cross-linking the thermosettable epoxy adhesive to form a cross-linked epoxy binder.

10. A method of claim 9 wherein the binder is solidified by heating for less than 5 minutes at 200° to 300° F.

11. A method of claim 9 further comprising the step of, prior to applying the layer of thermosettable epoxy adhesive, forming the adhesive by mixing predetermined quantities of an epoxy resin and a cross-linking agent capable of cross-linking the epoxy resin.

12. A method of claim 11 wherein the epoxy resin comprises the reaction product of epichlorohydrin and bisphenol A or bisphenol F and the cross-linking agent comprises an aliphatic amine.

13. A method of claim 9 wherein the layer is applied at a weight of 0.003 to 0.008 grams/$cm^2$.

* * * * *

UNITED STATES PATENT AND TRADEMARK OFFICE

CERTIFICATE OF CORRECTION

PATENT NO. : 5,656,351
DATED : August 12, 1997
INVENTOR(S) : L. Guy Donaruma

It is certified that error appears in the above-identified patent and that said Letters Patent is hereby corrected as shown below:

Column 4,
Line 33, please delete "I" and insert -- We --.

Signed and Sealed this

Twenty-sixth Day of February, 2002

*Attest:*

*Attesting Officer*

JAMES E. ROGAN
*Director of the United States Patent and Trademark Office*